US005643439A

United States Patent [19]

Sartori et al.

[11] Patent Number: 5,643,439

[45] Date of Patent: Jul. 1, 1997

[54] PROCESS FOR NEUTRALIZATION OF PETROLEUM ACIDS USING ALKALI METAL TRIALKYLSILANOLATES

[75] Inventors: Guido Sartori, Annandale; David W. Savage, Lebanon; Martin L. Gorbaty, Westfield; Bruce Henry Ballinger, Bloomsbury, all of N.J.

[73] Assignee: Exxon Research and Engineering Company, Florham Park, N.J.

[21] Appl. No.: 519,278

[22] Filed: Aug. 25, 1995

[51] Int. Cl.[6] ..... C10G 21/00

[52] U.S. Cl. ..... 208/47; 208/348; 252/387

[58] Field of Search ..... 208/47, 348; 252/387

[56] References Cited

U.S. PATENT DOCUMENTS

| | | | |
|---|---|---|---|
| 4,199,440 | 4/1980 | Verachtert | 208/230 |
| 4,300,995 | 11/1981 | Liotta | 208/8 LE |
| 4,436,846 | 3/1984 | Krantz | 252/363.5 |
| 4,647,366 | 3/1987 | Edmonson | 208/47 |
| 4,996,280 | 2/1991 | Saho et al. | 528/15 |
| 5,047,491 | 9/1991 | Saho et al. | 528/15 |
| 5,182,013 | 1/1993 | Petersen et al. | 208/348 |

*Primary Examiner*—Helane Myers

*Attorney, Agent, or Firm*—Linda M. Scuorzo

[57] ABSTRACT

The invention relates to a process for treating naphthenic acid-containing whole crudes or fractions thereof to reduce or eliminate their acidity by contacting the acidic whole crude at a temperature of from about 60° C. to 170° C. with a neutralizing amount of alkali metal trialkylsilanolates. The process has the additional benefits of reducing materials handling problems associated with treating crudes using liquid solvents and in reducing emulsion formation.

9 Claims, No Drawings

PROCESS FOR NEUTRALIZATION OF PETROLEUM ACIDS USING ALKALI METAL TRIALKYLSILANOLATES

FIELD OF THE INVENTION

The present invention relates to a process for neutralizing petroleum acids in order to increase the value of crudes or fractions thereof by rendering them less corrosive.

BACKGROUND OF THE INVENTION

Whole crudes with high petroleum acid content such as those containing naphthenic acids are corrosive to the equipment used to extract, transport and process the crude.

Efforts to minimize naphthenic acid corrosion have included a number of approaches. U.S. Pat. No. 5,182,013 refers to such recognized approaches as blending of higher naphthenic acid content oil with low naphthenic acid content oil. Additionally, a variety of attempts have been made to address the problem by using corrosion inhibitors for the metal surfaces of equipment exposed to the acids, or by neutralizing and removing the acids from the oil. Examples of these technologies include treatment of metal surfaces with corrosion inhibitors such as polysulfides (U.S. Pat. No. 5,182,013) or oil soluble reaction products of an alkynediol and a polyalkene polyamine (U.S. Pat. No. 4,647,366), by treatment of a liquid hydrocarbon with a dilute aqueous alkaline solution, specifically dilute aqueous NaOH or KOH (U.S. Pat. No. 4,199,440). These solutions form emulsions with the oil, necessitating use of only dilute aqueous base solutions. U.S. Pat. No. 4,300,995 discloses the treatment of carbonous materials particularly coal and its products such as heavy oils, vacuum gas oils and petroleum residua having acidic functionalities, with a dilute quaternary base such as tetramethylammonium hydroxide in a liquid (alcohol or water).

While these processes have achieved varying degrees of success there is a continuing need to develop more efficient methods for treating these acidity of whole crudes and fractions thereof.

SUMMARY OF THE INVENTION

The present invention provides for a process for decreasing the acidity of an acidic crude oil comprising: contacting an acidic whole crude oil at an elevated temperature with an effective amount of alkali metal trialkylsilanolate to produce a treated crude oil having a reduced acidity.

The present invention may suitably comprise, consist or consist essentially of the elements disclosed and may be practiced in the absence of an element not disclosed.

DETAILED DESCRIPTION OF THE INVENTION

Some whole crude oils contain organic acids that contribute to corrosion or fouling of refinery equipment. These organic acids generally fall within the category of naphthenic and other organic acids. Naphthenic acid is a generic term used to identify a mixture of organic acids present in petroleum stocks. Naphthenic acids alone or in combination with other organic acids such as phenols can cause corrosion at temperature ranging from about 65° C. (150° F.) to 420° C. (790° F.).

The crudes that may be used are any naphthenic acid-containing whole crude oils that are liquid or liquefiable at the temperatures at which the present invention is carried out. As used herein the term whole crudes means unrefined, undistilled crudes.

Applicants have discovered that acidic crudes, i.e., those containing naphthenic acids may be treated by contacting the crude with an effective amount of alkali metal trialkylsilanolate to produce a treated or final crude having a reduced or essential absence of acidity. The naphthenic acids may be present either alone or in combination with other organic acids, such as phenols. The acidic crudes are preferably whole crudes. However, acidic fractions of whole crudes also may be treated. The metal trialkylsilanolate may be solid or dissolved. An additional benefit of the treatment is the absence or substantial absence of emulsion formation. Emulsion formation is undesirable and a particular problem that is encountered during treatment of naphthenic acid-containing crudes with aqueous bases. The formation of a crude oil-aqueous emulsion tends to interfere with the efficient separation of the crude oil and water phases and thus with recovery of the crude oil. Thus, in addition to their corrosivity such acids must be removed from the crude oil due to their tendency to encourage emulsion formation during processing.

The contacting is typically carried out at an elevated temperature sufficient to reflux the solution. Typically, this is from about 50° C. to 170° C., preferably 100° C. to 150° C.

The metal trialkylsilanolates may be purchased commercially or synthesized using known procedures. The metal trialkylsilanolate is added to the acidic crude in an amount effective to produce a neutralized final crude oil. Typically, it is added preferably as a solid in a molar ratio of metal trialkylsilanolate to total acid of from 1:1 to about 10:1, preferably of from 2:1 to 1:1 or may be dissolved or suspended in a suitable solvent miscible with the crude, such as tetrahydrofuran or dichloromethane in the same silanolate to acid ratio. The addition of smaller amounts of metal trialkylsilanolate may result in an incomplete neutralization of the starting whole crude.

Reaction times depend on the nature of the crude to be treated, its acid content and the amount and type of metal trialkylsilanolate added, but typically may be carried out for from about 1 hour to about 20 hours to produce a product having a decrease in total acid content.

The concentration of acid in the crude oil is typically expressed as an acid neutralization number or acid number, which is the number of milligrams of KOH required to neutralize the acidity of one gram of oil. It may be determined according to ASTM D-664. Typically, the decrease in acid content may be determined by a decrease in the neutralization number or in the intensity of the carboxyl band in the infrared spectrum at about 1708 $cm^{-1}$. Whole crude oils with acid numbers of about 1.0 and lower are considered to be of moderate to low corrosivity. Crudes with acid numbers greater than 1.5 are considered corrosive. Acidic crudes having free carboxyl groups may be effectively treated using the process of the present invention.

While not wishing to be bound by any theory it is believed that the reaction takes place by neutralization of the acid groups on the naphthenic acid to produce a neutralized acid salt and the trialkylsilanol, e.g., $$R—COOH+(CH_3)_3SiONa \rightarrow RCOONa+(CH_3)_3SiOH$$

Whole crude oils are very complex mixtures in which a large number of competing reactions may occur. Unexpectedly, the reaction occurs completely although the acid is dilute in comparison to the large excess of crude and other reactive species typically present.

The process of the present invention has utility in processes in which inhibiting or controlling liquid phase corrosion, e.g., of metal surfaces, by acidic whole crude oils is desired. More generally, the present invention may be used in applications in which a reduction in the acidity, typically, as evidenced by a decrease in the neutralization number of the acidic whole crude or fraction thereof or a decrease in intensity of the carboxyl band in the infrared spectrum at about 1708 $cm^{-1}$ of the treated (neutralized) crude, would be beneficial and in which oil-aqueous emulsion formation and large solvent volumes are not desirable. The present invention also provides a method for controlling emulsion formation in acid crudes, by treating a major contributing component of such emulsions, naphthenic and similar organic acids, and by reducing the attendant handling and processing problems.

The present invention may be demonstrated with reference to the following non-limiting examples.

EXAMPLE 1

The reaction apparatus was a flask equipped with stirrer and reflux condenser, immersed in an oil bath. 50 g of San Juaquim Valley crude, having a neutralization number of 4.17 mg KOH/g, and 3.7 ml of a 1 molar solution of sodium trimethylsilanolate in tetrahydrofuran were put into the flask, which was kept under nitrogen. The oil bath temperature was brought to 100° C. and held there for 6 hours. After cooling, the treated crude had a neutralization number of 0.41 mg KOH/g.

EXAMPLE 2

The reaction apparatus was the same as in Example 1 and was kept under nitrogen. 50 g of the same crude used in Example 1 and 520 mg of potassium trimethylsilanolate were put into the flask. The oil bath was heated to 100° C. and held there for 8 hours. After cooling, the treated crude had a neutralization number of 0.31 mg KOH/g.

EXAMPLE 3

The reaction apparatus was the same as in Example 1 and was Kept under nitrogen. 50 g of the same crude used in Example 1 and 230 mg of lithium trimethylsilanolate were put into the flask. The oil bath was heated to 100° C. and held there for 6 hours. After cooling, the treated crude was analyzed and had a neutralization number of 0.89 mg KOH/g. This corresponded to 21% of the initial acidity still being present. Examination by infrared spectroscopy showed that the peak at 1708 $cm^{-1}$ had an intensity corresponding to 16% that of the untreated crude.

What is claimed is:

1. A process for decreasing the acidity of an acidic crude oil, comprising: contacting an acidic crude oil with an effective amount of from about 1:1 to 10:1 molar ratio of alkali metal trialkylsilanolate at temperature of from about 50° to 170° C. to produce a treated crude oil having a reduced acidity.

2. The process of claim 1 wherein the crude oil is an acidic whole crude oil.

3. The process of claim 1 wherein the crude oil is an acidic fraction of the crude oil.

4. The process of claim 1, wherein the metal trialkylsilanolate is selected from the group consisting of sodium, potassium and lithium, trimethylsilanolates.

5. The process of claim 1 wherein the oil acidic crude has a neutralization number of from about 0.5 to 10 mg KOH/g.

6. The process of claim 1 wherein elevated temperature is from about 50° C. to 170° C.

7. The process of claim 1 wherein the oil is a naphthenic acid-containing crude oil.

8. The process of claim 1 wherein the treated oil contains metal carboxylates of naphthenic acid.

9. The process of claim 1 wherein the reduction in acidity of the treated oil is produced in the substantial absence of emulsion formation.

* * * * *